United States Patent [19]

Chapalain

[11] 4,365,391

[45] Dec. 28, 1982

[54] DEVICE FOR LOCKING AND ADJUSTING STRAPS FOR LIFTING AND SECURING APPARATUSES

[76] Inventor: Jean-Pierre Chapalain, 22, Rue de Méry, 95310 Saint-Ouen-l'Aumone, France

[21] Appl. No.: 169,654

[22] Filed: Jul. 17, 1980

[30] Foreign Application Priority Data

Jul. 18, 1979 [FR] France ..... 79 18580

[51] Int. Cl.[3] ..... A44B 11/00

[52] U.S. Cl. ..... 24/197; 24/200

[58] Field of Search ..... 24/197, 196, 200, 193, 24/68 F

[56] References Cited

U.S. PATENT DOCUMENTS

| | | | |
|---|---|---|---|
| 2,429,926 | 10/1947 | Davis | 24/197 |
| 3,131,450 | 5/1964 | Zinkel, Jr. | 24/197 |
| 3,707,022 | 12/1972 | Diehl | 24/197 X |
| 3,887,966 | 6/1975 | Gley | 24/200 |
| 4,110,940 | 9/1978 | Vanderlyn | 24/197 X |

FOREIGN PATENT DOCUMENTS

| | | | |
|---|---|---|---|
| 907363 | 2/1954 | Fed. Rep. of Germany | 24/197 |
| 1937155 | 4/1971 | Fed. Rep. of Germany | 24/197 |
| 622699 | 3/1927 | France | 24/197 |
| 1384128 | 11/1963 | France | 24/197 |
| 1394524 | 2/1965 | France | 24/197 |
| 2087211 | 12/1971 | France | 24/197 |

*Primary Examiner*—William E. Lyddane
*Assistant Examiner*—Peter A. Aschenbrenner

[57] ABSTRACT

This device for locking and adjusting a strap comprises a case fixed to a suspension member such as a hook, ring, clevis or shackle, the sides of said case having therethrough two and preferably three series of facing holes and whose face projecting from the plane of the suspension member is folded back at its base towards its other face so as to form a slit having a length equal to the width of the strap whose active strand penetrates into the case through said slit in the plane of the suspension element before being wound around two parallel removable shafts engaged in the case through the lower lateral holes, possibly after passing over a removable pin housed parallel above said shafts and engaged in the case through the upper lateral holes, so as to be able to adjust the length of the strap by pulling on the return strand or on both strands if the pin to be withdrawn for locking is present.

2 Claims, 6 Drawing Figures

DEVICE FOR LOCKING AND ADJUSTING STRAPS FOR LIFTING AND SECURING APPARATUSES

BACKGROUND OF THE INVENTION

To avoid direct contact of the straps with the lifting hooks or other suspension fittings, which often cause deformation of the straps and considerable local stresses and premature wear, the ends of the straps, and particularly lifting and securing straps, are generally fitted with end-pieces for ensuring the functional connection between the strap and the suspension element.

The means for connecting these end-pieces to the lifting apparatus or similar consist generally of a round ring, an oblong ring, a suspension clevis, a so-called swivelling pivot eye, a hook, a shackle, etc . . . , whereas the connection with the strap is most often formed by a straight beam around which the strap is folded back on itself, the active strand being held against the return strand by stitching.

The loop of the strap thus formed may in particular be engaged on the transverse pin of a clevis which comprises for this purpose the end-piece. But most frequently the strap is disposed on a closed ring comprising a flat base.

A first disadvantage of such an arrangement is that the strap fitted with such an end-piece has a predetermined length which cannot be modified; furthermore, the stitching reduces the strength of the strap which must be consequently chosen so that its breaking strength is greater than that which would be required if it did not comprise such stitching.

There have also been proposed strap tensioners comprising three shafts aligned on a support, the active strand passing over the first shaft, then being wound in a figure of eight around the other two shafts, thus forming triple locking of the return strand, which obviously makes it impossible to adjust the length of the strap.

SUMMARY OF THE INVENTION

The present invention provides then an end-piece for a strap which allows both adjustment of the length of the useful part of the strap and locking thereof in service.

This device for locking and adjusting a strap comprises a case fixed to a suspension member such as a hook, ring, clevis or shackle, the sides of this case having two and preferably three series of facing holes therethrough and whose face projecting from the plane of the suspension member is folded back at its base towards the other face so as to form a slit of a length equal to the width of the strap whose active strand penetrates into the case through this slit in the plane of the suspension element before being wound around two parallel removable shafts engaged in the case through the lower lateral holes, after possibly passing over a removable pin housed parallel above said shafts and engaged in the case through the upper lateral holes, so as to be able to adjust the length of the strap by pulling the return strand or both strands in the case where there is present the pin to be withdrawn for locking.

Thus it can be seen that the greater the tension exerted on the working strand, the greater is the pressure applying the clossed and open loops on their sectors in contact with the front and rear shafts of the clevis and, consequently, the greater is the resistance to sliding of the strap on the shafts.

To facilitate engagement of the closed and open loops on the front and rear shafts of the clevis, these latter may be preferably removable for forming first of all the loop and counter loop at the end of the clevis, engaging them in the clevis of the end-piece and only then mounting the shafts of this clevis through these previously formed closed and open loops.

The present invention also relates to the part receiving the shafts for winding the strap and which allows furthermore adjustment of the strap, not only to reduce the length thereof but to increase it.

To this end, the end-piece may comprise further a pin parallel to the two winding shafts.

The process for fixing the end of the strap to such an end-piece will consist in installing the strap on the clevis, as was outlined above, then in sliding its active strand upwards, in engaging the thus freed part of this active strand around the pin, in freely adjusting the length of the strap by acting on its free strand or on its active strand, in withdrawing the pin and exerting a tractive force on the free strand so as to ensure proper contact between the strap and the shafts of the clevis.

This end-piece connected to the lifting or securing member and having the form of a case supporting the two winding shafts and the removable pin allows not only locking a service, after withdrawing the pin, the strap being wound in a figure of eight around the two shafts, the active strand and the return strand being in the slit at the base of the case in the plane of the member of the end-piece, so that the action of the strands is correctly exerted, but also adjustment of the strap length by placing the pin so that the active strand winds up or unwinds easily, since it is no longer subjected to a tension around the two winding shafts.

DESCRIPTION OF THE DRAWINGS

The enclosed drawings show by way of example two embodiments of the present invention.

DESCRIPTION OF THE PREFERRED EMBODIMENTS

Figure 1:
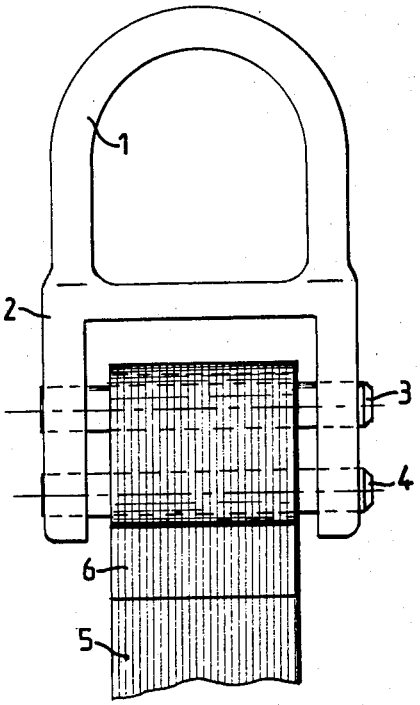
FIG. 1 is an elevational view of an end-piece formed in accordance with a first embodiment, with the strap to the end of which it is fixed.
Figure 2:
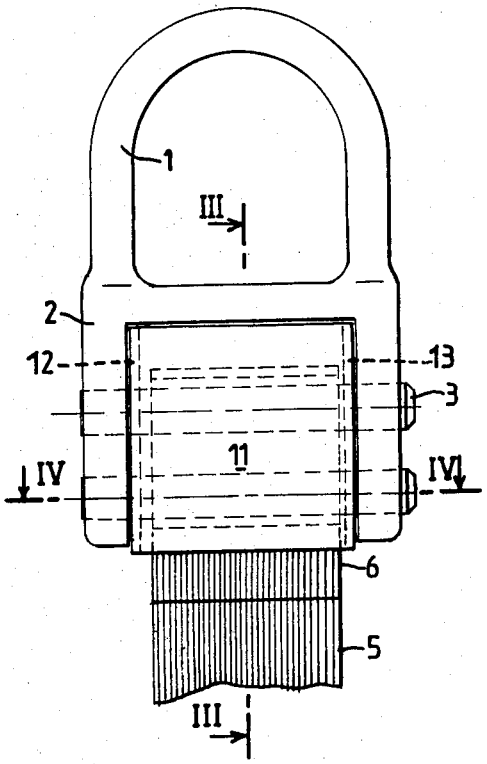
FIG. 2 is a similar view after positioning of the protecting case.
Figure 3:
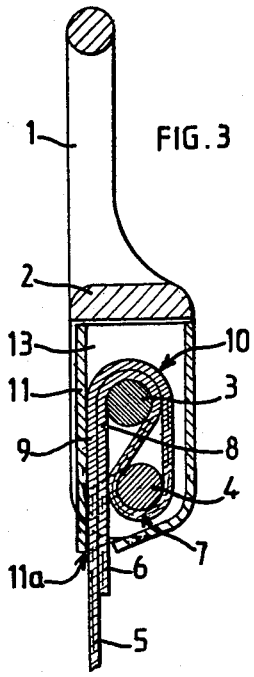
FIG. 3 is a sectional view along line III—III of FIG. 2.
Figure 4:
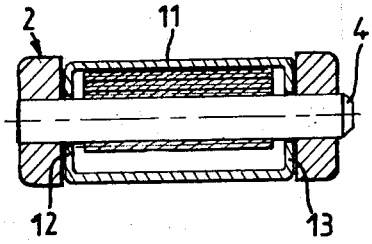
FIG. 4 is a sectional view along line IV—IV of FIG. 2.

The end-piece shown in FIGS. 1 to 4 comprises its usual ring 1 for engaging on the hook of the lifting or securing appliance with which it is used; it is completed by a clevis 2 through which pass two parallel shafts 3 and 4 disposed one behind the other.

Preferably, ring 1 will be situated in the same plane as the active strand 5 of the strap, which will be described further on.

To fix the end of strap 5 to this end-piece, its free end 6 is first of all folded back thereagainst so as to form a closed loop 7; the free strand 8 and working strand 9 portion leading to this closed loop 7 is then folded back around the rear shaft 3 of the clevis so as to form an open loop 10, the free strand being in contact with the surface of this shaft and the working strand above; closed loop 7 is then engaged on the front shaft 4 of clevis 2 and, to ensure proper contact between free strand 8 and these two shafts 3 and 4, a pull is exerted on its end 6 and, possibly, also on the working strand 5 of the strap.

To facilitate this mounting, the rear 3 and front 4 shafts of the clevis of the end-piece may be removable and only introduced after the closed loop 7 has been formed, after it has been folded back with the two lengths of the free strand 8 and of the working strand 9 of strap 5 which lead to said closed loop so as to form the open loop 10 and after the whole thus formed has been engaged between the two parallel arms of the clevis.

This end-piece may be completed by a protecting case 11 whose dimensions are such that it may be introduced between the two parallel arms of clevis 2 and so that its width is substantially the same as that between said arms; its lateral faces 12 and 13 have holes therethrough for passing shafts 3 and 4. The rear opening of case 11 is applied against the bottom of clevis 2 and its front opening forms a slit 11*a* for passing the strap strands 5 and 6 therethrough.

Furthermore, the case may carry any information useful to the executant personnel on the work-site. The end-piece equipped with such a case presents no risk of catching.

Figure 6:
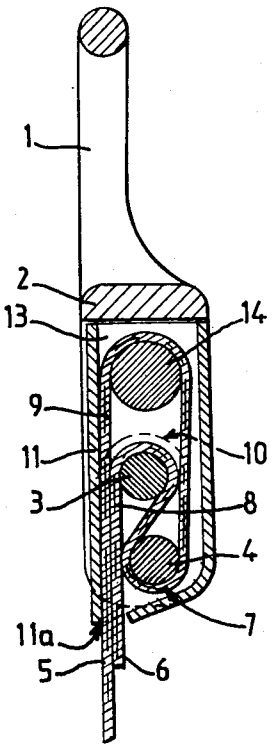
FIG. 6 is a sectional view along line VI—VI of FIG. 5.
Figure 5:
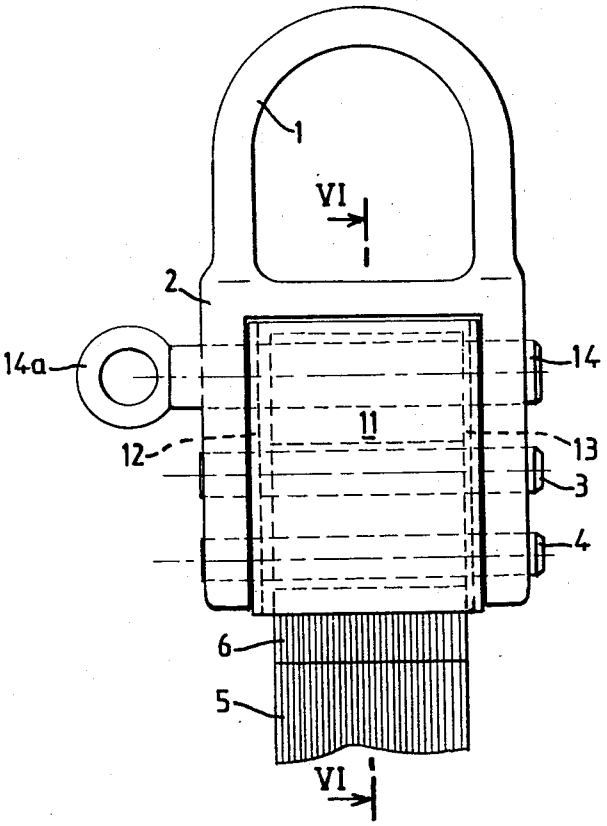
FIG. 5 is a similar view to FIG. 2 of an end-piece formed in accordance with a second embodiment.

FIGS. 5 and 6 show an end-piece whose clevis 2 is equipped furthermore with a pin 14 which is situated above shaft 3 and which, preferably, is chosen with a diameter greater than that of shafts 3 and 4 so as to avoid any risk of confusion therewith during handling and ends at one end (FIG. 5) in a ring 14*a* or any other means enabling it to be easily located and handled.

The purpose of this pin 14 is to allow adjustment of the strap not only to increase but also to reduce the length thereof.

After installing the strap on shafts 3 and 4 (position given with a broken line in FIG. 6), strand 5 is slid upwards and pin 14 is then positioned around the thus freed part 9 of strand 5. The strap may then be adjusted by acting either on strand 5 or on strand 6. After carrying out this adjustment, pin 14 is withdrawn and the strap assumes again the position in which only the free strand 6 can be acted on.

It will be understood that the embodiments of the invention which have just been described above with reference to the accompanying drawings have been given purely by way of indication and are in no wise limiting and that numerous modifications can be made without departing from the spirit and scope of the present invention; thus, in particular, shafts 3 and 4 may be not cylindrical in order to be better adapted to the forces which they have to withstand; they may be reinforced in their central part; the rear shaft 3 may be fixed and the front shaft 4 removable.

What is claimed is:

1. A device for locking and adjusting the length of a lifting and securing strap, comprising a suspension element disposed in a plane, a clevis integral with said element having parallel arms, at least two superposed holes in each arm of said clevis, the holes in one arm of said clevis facing the holes in the other arm of said clevis, at least two superposed shafts removably disposed in said holes, a case fixed on said clevis having one side disposed out of the plane of said suspension element, said side being bent back substantially at right angles at one end thereof towards a side of said case which is opposite to said one side of said case so as to form therewith a slit in the plane of said suspension element, and a strap having an active strand passing through said slit and wound around said shafts, and said strap having a return strand in contact with the active strand leaving through the slit, said slit maintaining the active strand of the strap against the return strand in the plane of the suspension member.

2. A device according to claim 1, wherein there is a third hold in each arm of said clevis facing each other and disposed above said shafts, a pin removably disposed in said third holes, said active strand of the strap passing over said pin before being wound around said shafts when it is required to adjust the length of the strap.

* * * * *